US006962058B2

(12) United States Patent
Kim et al.

(10) Patent No.: US 6,962,058 B2
(45) Date of Patent: Nov. 8, 2005

(54) AIR CONDITIONER AND METHOD OF CONTROLLING SUCH

(75) Inventors: Jong-Youb Kim, Suwon (KR); Il-Yong Cho, Seoul (KR); Je-Myoung Moon, Suwon (KR); Joong-Ki Moon, Seoul (KR); Chang-Hee Han, Chunju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/470,055

(22) PCT Filed: Feb. 18, 2002

(86) PCT No.: PCT/KR02/00245

§ 371 (c)(1),
(2), (4) Date: Nov. 25, 2003

(87) PCT Pub. No.: WO03/046444

PCT Pub. Date: Jun. 5, 2003

(65) Prior Publication Data

US 2004/0079097 A1 Apr. 29, 2004

(30) Foreign Application Priority Data

Nov. 24, 2001 (KR) ..... 2001-73628

(51) Int. Cl.[7] ..... F25B 7/00; F25B 1/10

(52) U.S. Cl. ..... 62/175; 62/158; 62/228.4; 62/228.5; 62/510

(58) Field of Search ..... 62/228.5, 228.4, 62/175, 510, 157, 158; 165/287

(56) References Cited

U.S. PATENT DOCUMENTS 3,864,611 A * 2/1975 Chang ..... 318/484
4,749,881 A * 6/1988 Uhrich ..... 307/41
5,050,397 A * 9/1991 Sugiyama et al. ..... 62/175
5,216,897 A * 6/1993 Tsuchiyama ..... 62/158
6,018,957 A * 2/2000 Katra et al. ..... 62/175
6,047,557 A * 4/2000 Pham et al. ..... 62/228.5
6,216,479 B1 * 4/2001 Elwood ..... 62/230
6,330,804 B1 * 12/2001 Uno et al. ..... 62/175
6,434,957 B1 * 8/2002 Nishizuka et al. ..... 62/175
6,732,539 B2 * 5/2004 Moon et al. ..... 62/175
6,735,965 B2 * 5/2004 Moon et al. ..... 62/175

FOREIGN PATENT DOCUMENTS

JP 2002-317992 10/2002

* cited by examiner

*Primary Examiner*—Marc Norman
(74) *Attorney, Agent, or Firm*—Staas & Halsey LLP

(57) ABSTRACT

The object of this invention is to provide an air conditioner with a variable capacity compressor (2) parallely connected to a fixed capacity compressor (4), and a method of controlling the operation of such an air conditioner. When it is required to start the fixed capacity compressor (4) in addition to an operation of the variable capacity compressor (2) due to an increase in the sum of the required cooling capacities of indoor units (9), an outdoor control unit (13) starts the fixed capacity compressor (4) during an unloading mode operation of the variable capacity compressor (2) where the pressure difference between the outlet side and inlet side of the variable capacity compressor is minimized. The fixed capacity compressor (4) is thus smoothly started without causing an induction of excessive starting current, and improves the operational reliability of the air conditioner.

5 Claims, 8 Drawing Sheets

AIR CONDITIONER AND METHOD OF CONTROLLING SUCH

TECHNICAL FIELD

The present invention relates, in general, to air conditioners and a method of controlling such air conditioners and, more particularly, to an air conditioner with a variable capacity compressor and a fixed capacity compressor, and a method of controlling the operation of such an air conditioner by operating the fixed capacity compressor in consideration of the operational condition of the variable capacity compressor.

BACKGROUND ART

In accordance with the recent trend of up-scale of buildings, consumer's requirements for multi-air conditioners with several indoor units commonly connected to one outdoor unit have increased. In a multi-air conditioner, the required cooling capacities of the indoor units are different from each other and the indoor units are independently operated, and so the total cooling capacity of the air conditioner, which is calculated by the sum cooling capacities of the indoor units, is also variable. It is thus necessary to control the capacity of a compressor and control the opening ratio of the electric expansion valve, installed at the upstream of an evaporator used as a heat exchanger of each indoor unit, in accordance with a variation in the total cooling capacity of the air conditioner.

In order to accomplish the variable cooling capacity of such multi-air conditioners, variable capacity compressors with variable refrigerant compressing capacity have been used. Such variable capacity compressors are typically classified into two types: variable rpm compressors and pulse width modulation compressors. In a variable rpm compressor, the motor's rpms are controlled in accordance with a variation in the sum of the required cooling capacities of indoor units by changing, through an inverter control, the frequency of the current applied to the compressor. The capacity of the variable rpm compressor is thus controlled and accomplishes the variable cooling capacity in a multi-air conditioner. In a pulse width modulation compressor, the capacity of the compressor is controlled in response to a duty control signal which determines the loading time when the compressor discharges compressed refrigerant and the unloading time when the compressor ceases to discharge compressed refrigerant. The pulse width modulation compressor thus accomplishes the variable cooling capacity of a multi-air conditioner.

However, the variable capacity of such compressors typically used in multi-air conditioners is limited. During the operation of such a multi-air conditioner, the sum of the required cooling capacities of the indoor units, which are commonly connected to one outdoor unit, may exceed the capacity of one variable capacity compressor installed in the air conditioner. Therefore, it is necessary to install an additional variable capacity compressor in the air conditioner.

However, such variable capacity compressors are expensive and difficult to install in multi-air conditioners in comparison with fixed capacity compressors which have fixed refrigerant compressing capacity. Therefore, in the prior art, both a variable capacity compressor and a fixed capacity compressor are installed in a multi-air conditioner and are parallely connected to each other in order to meet the demands of the variable cooling capacities of the indoor units.

In the operation of a multi-air conditioner with two such types of compressors, the cooling operation of the indoor units is performed by using only the variable capacity compressor when the sum of the required cooling capacities of the indoor units varies within the allowable capacity range of the variable capacity compressor. When the sum of the required cooling capacities of the indoor units exceeds the capacity of the variable capacity compressor, the fixed capacity compressor is operated at the same time to meet the required cooling capacities of the indoor units.

However, the conventional multi-air conditioner with both compressors is designed such that the fixed capacity compressor is started regardless of the operational condition of the variable capacity compressor, and so an excessive starting current may be induced in the fixed capacity compressor. Such a starting current prevents the smooth start of the fixed capacity compressor, and reduces the starting performance of said compressor. Furthermore, the excessive starting current sometimes damages the fixed capacity compressor, and causes a reduction in the operational reliability of the air conditioner.

DISCLOSURE OF THE INVENTION

Accordingly, the present invention has been made keeping in mind the above problems occurring in the prior art, and an object of the present invention is to provide an air conditioner with a variable capacity compressor and a fixed capacity compressor, and a method of controlling the operation of such an air conditioner by operating the fixed capacity compressor in consideration of the operational condition of the variable capacity compressor, thus accomplishing the smooth start of the fixed capacity compressor.

In order to accomplish the above object, the present invention provides an air conditioner, comprising: a fixed capacity compressor with fixed refrigerant compressing capacity; a variable capacity compressor operated in a loading mode for discharging refrigerant and in an unloading mode for ceasing to discharge refrigerant, with refrigerant compressing capacity of the variable capacity compressor varying in response to a duty control signal which determines a loading time and an unloading time within a cycle; and a control unit starting the fixed capacity compressor and the variable capacity compressor with a difference in time so as to prevent a synchronous start of the fixed capacity compressor and the variable capacity compressor.

In the above air conditioner, the control unit starts the fixed capacity compressor after starting the variable capacity compressor.

The control unit also starts the fixed capacity compressor such that the total current, which is the sum of a starting current of the fixed capacity compressor and an operating current of the variable capacity compressor, does not exceed a maximum allowable current.

The control unit also starts the fixed capacity compressor during an unloading mode operation of the variable capacity compressor when it is required to start the fixed capacity compressor.

In the case of the variable capacity compressor constantly maintaining a loading mode even though it is required to start the fixed capacity compressor, the control unit forcibly converts the loading mode of the variable capacity compressor into an unloading mode, and starts the fixed capacity compressor after the mode conversion.

The present invention also provides a method of controlling an air conditioner consisting of a fixed capacity compressor with fixed refrigerant compressing capacity, and a variable capacity compressor being varied in refrigerant compressing capacity in response to a duty control signal determining a loading time and an unloading time within a cycle, wherein the method comprises the steps of: starting the variable capacity compressor; determining whether it is required to start the fixed capacity compressor in addition to an operation of the variable capacity compressor; and starting the fixed capacity compressor in accordance with an operational condition of the variable capacity compressor when it is required to start the fixed capacity compressor.

In the above method, the step of starting the fixed capacity compressor comprises the steps of: determining whether the variable capacity compressor is operating in an unloading mode; and starting the fixed capacity compressor under the condition that the variable capacity compressor is operating in an unloading mode.

The step of starting the fixed capacity compressor may comprise the step of: starting the fixed capacity compressor after waiting for a conversion in the operational mode of the variable capacity compressor from a loading mode into an unloading mode when the variable capacity compressor is being operated in the loading mode.

The step of starting the fixed capacity compressor may comprise the step of: starting the fixed capacity compressor after forcibly converting an operational mode of the variable capacity compressor from a loading mode into an unloading mode when the variable capacity compressor is continuously operated in the loading mode.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
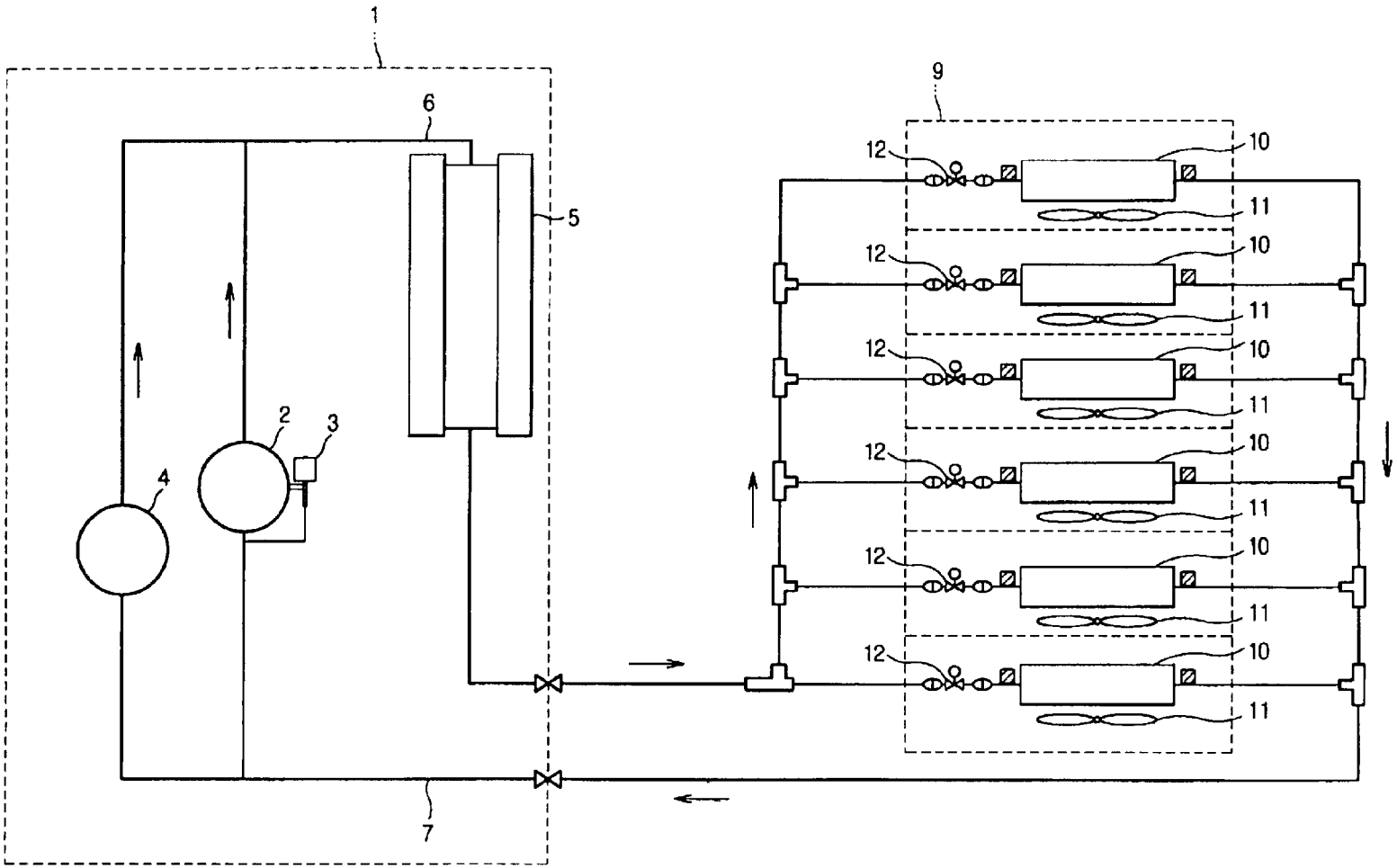
FIG. 1 is a circuit diagram showing the refrigeration cycle of the air conditioner according to the primary embodiment of the present invention.

Reference now should be made to the drawings, in which the same reference numerals are used throughout the different drawings to designate the same or similar components.

FIG. 1 is a circuit diagram showing the refrigeration cycle of the multi-air conditioner according to the preferred embodiment of the present invention.

As shown in the drawing, the multi-air conditioner of this invention comprises one outdoor unit 1 and a plurality of indoor units 9. The outdoor unit 1 includes a variable capacity compressor 2, a fixed capacity compressor 4, and a condenser 5. The two compressors 2, 4 are parallely connected to each other. The variable capacity compressor 2 is a pulse width modulation compressor, which is operated in a loading mode for discharging refrigerant and an unloading mode for not discharging refrigerant. A PWM valve 3 controls the loading and unloading mode operation of the variable capacity compressor 2. The fixed capacity compressor 4 is a general type compressor, which is selectively operated by being electrically turned on or off, and is rotated at a constant rpm.

The indoor units 9 are parallely connected to the outdoor unit 1, and each include an evaporator 10 and an electric expansion valve 12. In a brief description, the multi-air conditioner has an arrangement consisting of the parallel connection of several indoor units 9 to one outdoor unit 1. The capacities and types of the indoor units 9 may be equal to or different from each other without affecting the functioning of this invention.

In the outdoor unit 1, the variable capacity compressor 2 and the fixed capacity compressor 4 are parallely connected to each other between the high pressure outlet pipe 6 and the low pressure inlet pipe 7. The high pressure outlet pipe 6 is a refrigerant outlet pipe which guides discharged refrigerant from the compressors 2, 4 to the condenser 4. The low pressure inlet pipe 7 is a refrigerant inlet pipe which guides refrigerant from the evaporators 10 of the indoor units 9 to the two compressors 2 and 4.

Figure 2:
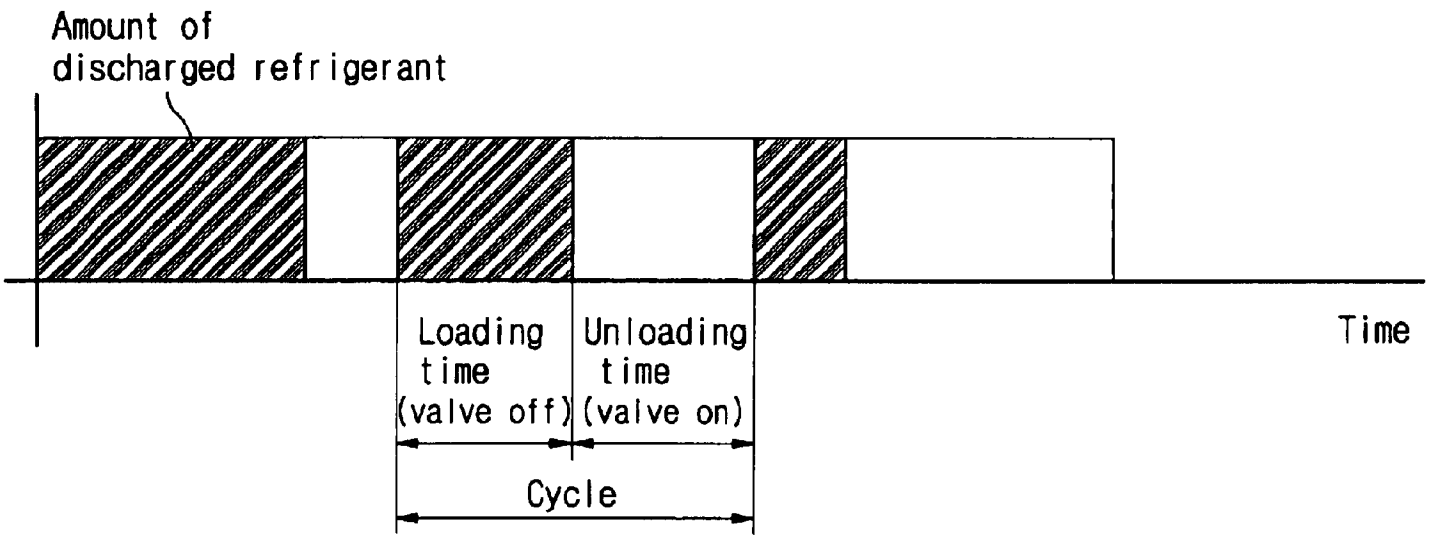
FIG. 2 is a view showing a relationship between the loading and unloading times and the amount of refrigerant discharged from the compressor of this invention.

As shown in FIG. 2, the variable capacity compressor 2 alternately performs the loading mode operation with the PWM valve 3 turned off to discharge refrigerant, and the unloading mode operation with the PWM valve 3 turned on to cease to discharge refrigerant. In the operation of such a compressor 2, the loading and unloading time varies in response to a duty control signal applied to an outdoor control unit in accordance with the sum of the required cooling capacities of the indoor units 9. The outdoor control unit will be described in detail later herein. The shaded surface areas in FIG. 2 indicate the amounts of discharged refrigerant.

Figure 3:
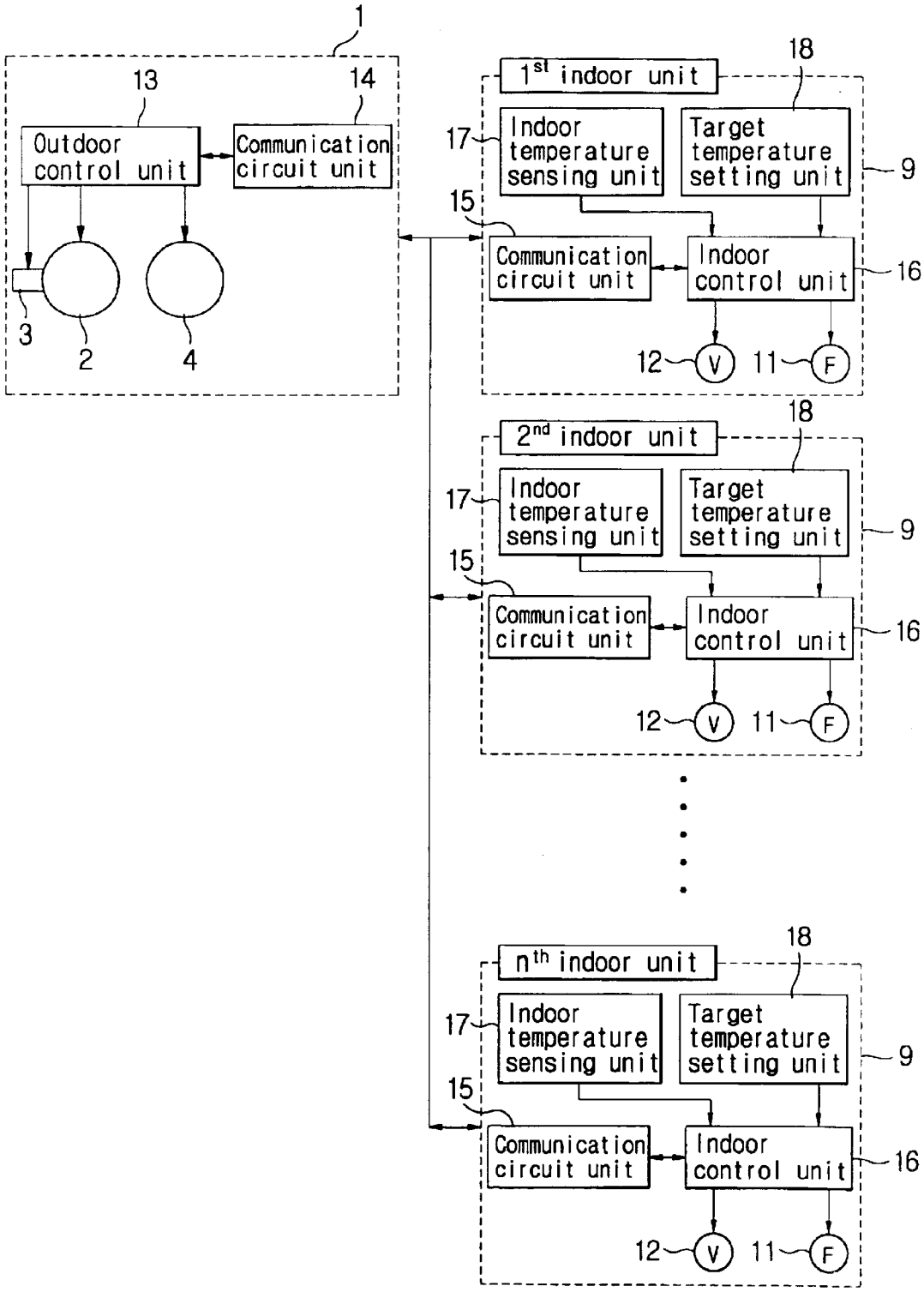
FIG. 3 is a block diagram showing the construction of the control system of the air conditioner according to this invention.

FIG. 3 is a block diagram showing the construction of the control system of the air conditioner according to this invention.

As shown in FIG. 3, the outdoor unit 1 includes an outdoor control unit 13 and an outdoor communication circuit unit 14, in addition to the variable capacity compressor 2, the PWM valve 3, and the fixed capacity compressor 4. The outdoor control unit 13 is connected to the variable capacity compressor 2, the PWM valve 3, the fixed capacity compressor 4, and the communication circuit unit 14 so as to transceive signals with them. The outdoor communication circuit unit 14 tranceives data signals with the indoor units 9.

Each of the indoor units 9 includes an indoor fan 11, electric expansion valve 12, indoor communication circuit unit 15, indoor control unit 16, indoor temperature sensing unit 17, and a target temperature setting unit 18. The indoor control unit 16 is connected to the fan 11, electric expansion valve 12, indoor communication circuit unit 15, indoor temperature sensing unit 17, and the target temperature setting unit 18 so as to transceive signals with them. The indoor communication circuit unit 15 tranceives data signals with the outdoor unit 1.

The control unit 16 of each indoor unit 9 receives a present indoor temperature sensed by the indoor temperature sensing unit 17 and a target temperature preset by the target temperature setting unit 18. Each of the indoor control units 16 stores the designed cooling capacity information of an associated indoor unit, and may calculate required cooling capacity of the indoor unit on the basis of a temperature difference between the present indoor temperature and the target temperature, and the designed cooling capacity of the indoor unit. Alternatively, the indoor control unit 16 may calculate the required cooling capacity on the basis of the designed cooling capacity of the indoor unit exclusively. Signals, representing the required cooling capacities calculated by the control units 16 of the indoor units 9, are transmitted to the outdoor control unit 13 through the indoor and outdoor communication circuit units 15 and 14.

Upon receiving the signals from the indoor control units 16, the outdoor control unit 13 calculates the sum of the required cooling capacities of the indoor units 9, and controls the operation of the two compressors 2, 4 in accordance with the sum of the required cooling capacities. When the sum of the required cooling capacities of the indoor units 9 does not exceed the capacity of the variable capacity compressor 2, the outdoor control unit 13 operates only the variable capacity compressor 2 while controlling the output of the compressor 2 by outputting duty control signals to the compressor 2 in accordance with a variation in the sum of the required cooling capacities. When the sum of the required cooling capacities of the indoor units 9 exceeds the capacity of the variable capacity compressor 2, the outdoor control unit 13 initiates the fixed capacity compressor 4 in addition to the variable capacity compressor 2. In such a case, the outdoor control unit 13 also controls the output of the variable capacity compressor 2 by outputting duty control signals to said compressor 2 in accordance with a variation in the sum of the required cooling capacities of the indoor units 9.

During such a control operation of the outdoor control unit 13, the unit 13 may fail to smoothly operate the fixed capacity compressor 4 if it directly starts the compressor 4 regardless of the operational condition of the variable capacity compressor 2 when the sum of the required cooling capacities of the indoor units 9 increases to require the operation of the two compressors 2 and 4. That is, when the fixed capacity compressor 4 is forcibly started at its inactivated state where a large pressure difference exists between the high pressure side and the low pressure side of the compressor 4, an excessive starting current is induced and the starting performance of said compressor 4 is reduced.

Figure 4A:
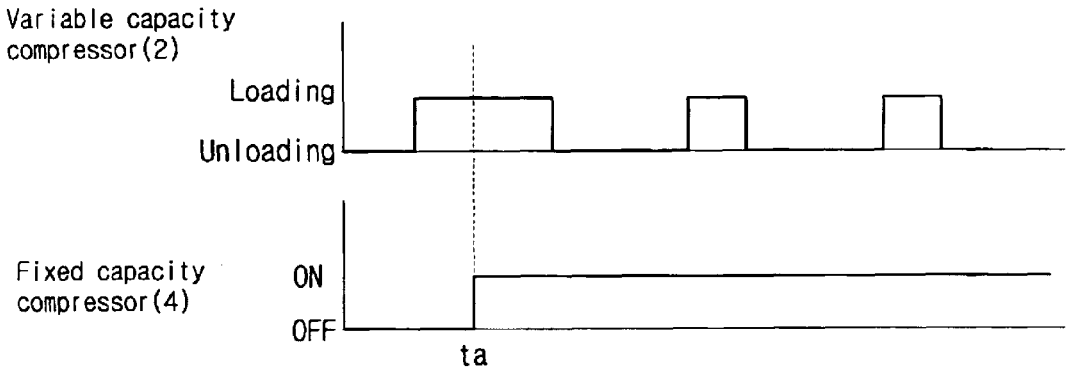
FIGS. 4*a* and 4*b* are graphs showing the induction of an excessive current in the fixed capacity compressor by operation of the variable capacity compressor and the fixed capacity compressor at the same time.
Figure 4B:
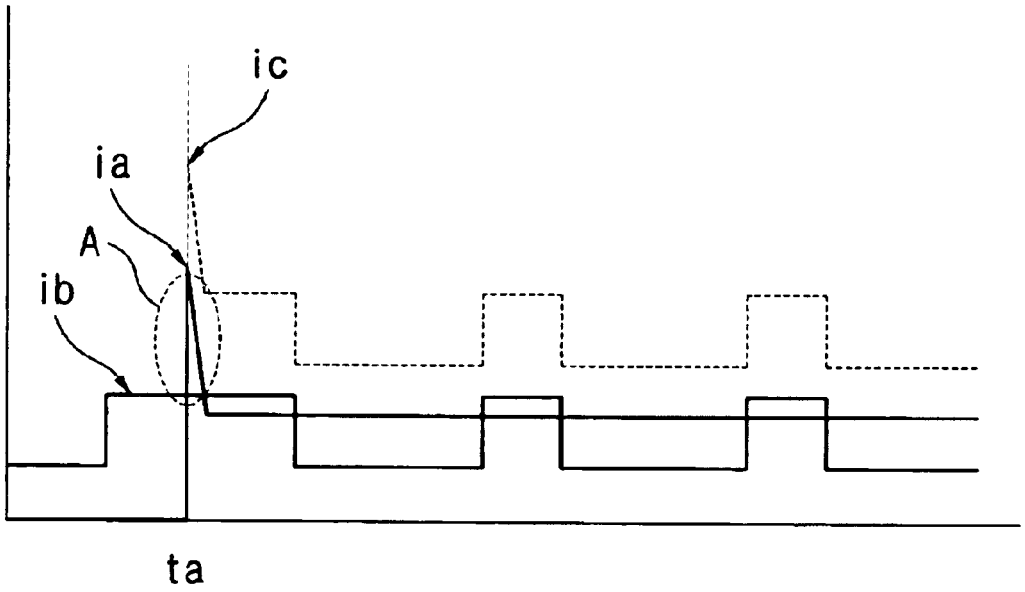

When the fixed capacity compressor 4 is turned on to start at a time "ta" during a loading mode operation of the variable capacity compressor 2 where refrigerant is discharged from said compressor 2 as shown in FIGS. 4*a* and 4*b*, the total current "ic", which is the sum of the starting current "ia" of the fixed capacity compressor 4 and the operating current "ib" of the variable capacity compressor 2, quickly increases to exceed the maximum allowable current. Such a quick increase in the current prevents the smooth starting of the compressor 4, reduces the starting performance of the compressor 4, and causes damage to the compressor 4.

In order to overcome such a problem, the outdoor control unit 13 starts the fixed capacity compressor 4 in consideration of the operational condition of the variable capacity compressor 2 when it is required to start the compressor 4 due to an increase in the sum of the required cooling capacities of the indoor units 9. In the present invention, it is preferable to design the outdoor control unit 13 such that it starts the fixed capacity compressor 4 during an unloading mode operation of the variable capacity compressor 2, thus preventing an induction of excessive starting current in the fixed capacity compressor 4 and performing a smooth start of said compressor 4.

Figure 5A:
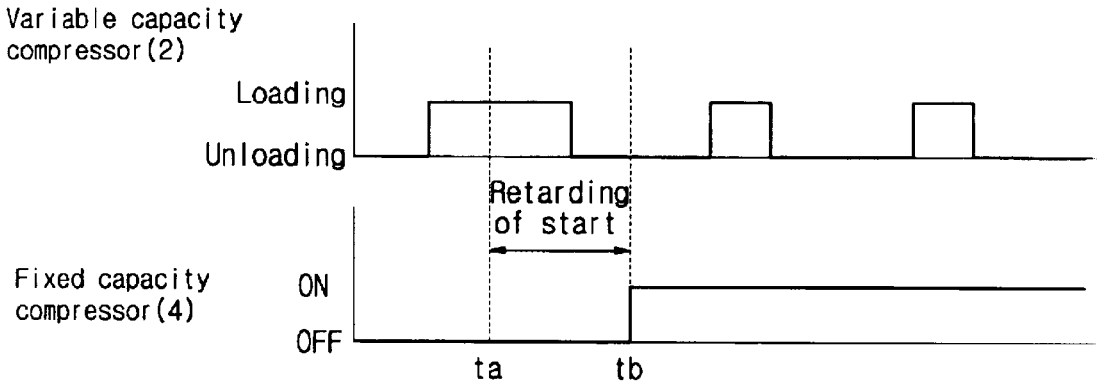
FIGS. 5*a* and 5*b* are graphs showing the operation of the air conditioner, according to the present invention, which controls the fixed capacity compressor in consideration of the operational condition of the variable capacity compressor.

As shown in FIG. 5*a*, when the fixed capacity compressor 4 is required to start at a time "ta" during a loading mode operation of the variable capacity compressor 2, the outdoor control unit 13 retards the start of the compressor 4 for a predetermined period of time. In such a case, the "predetermined period of time" is the time consumed by the variable capacity compressor 2 until the compressor 2 is converted from the loading mode into an unloading mode.

After the variable capacity compressor 2 is completely converted from the loading mode into the unloading mode, the fixed capacity compressor 4 is started under the control of the outdoor control unit 13 at a time "tb".

Figure 5B:
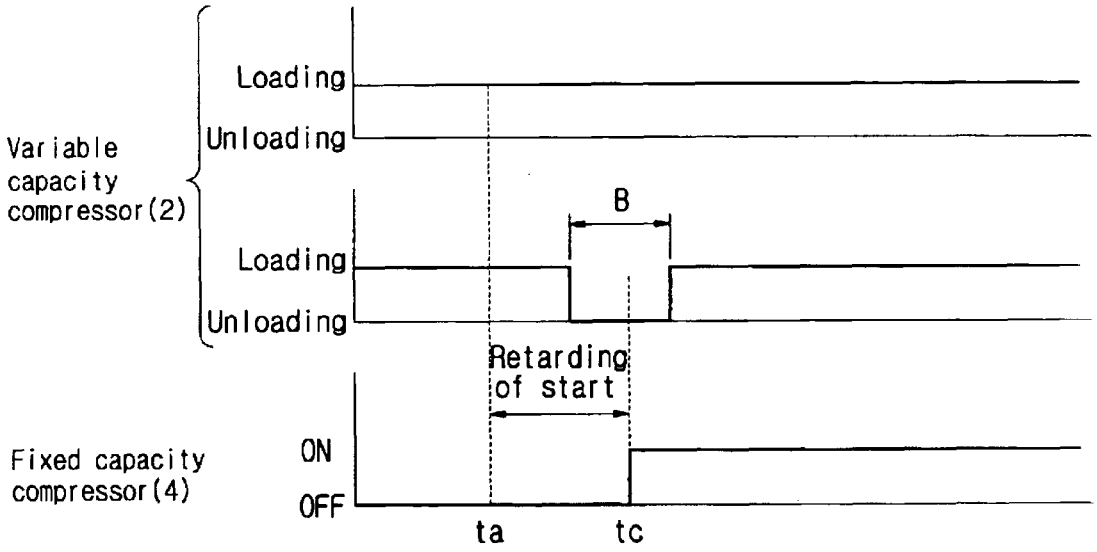

When it is required to start the fixed capacity compressor 4 even though the variable capacity compressor 2 maintains its loading mode with full capacity (100%) as shown in FIG. 5*b*, the outdoor control unit 13 may retard the start of the fixed capacity compressor 4 for an excessively lengthy period of time while waiting for a conversion from the loading mode of the compressor 2 to an unloading mode. In such a case, the starting of the fixed capacity compressor 4 is not accomplished in a timely manner. Therefore, the outdoor control unit 13 forcibly converts the loading mode of the variable capacity compressor 2 into an unloading mode and maintains the unloading mode for a predetermined period of time "B" as shown in FIG. 5*b* when the fixed capacity compressor 4 is required to start even though the variable capacity compressor 2 maintains its loading mode operation with full capacity. The outdoor control unit 13 starts the fixed capacity compressor 4 at a time "tc" after such a mode conversion.

In such a case, the "predetermined period of time B" is preferably set to within one cycle of the duty control signal which controls the variable capacity compressor 2, in an effort to quickly attend to the restarting of the variable capacity compressor 2.

The "predetermined period of time B" is also preferably set in consideration of the time required by the fixed capacity compressor 4 to operate normally after the start.

Figure 6:
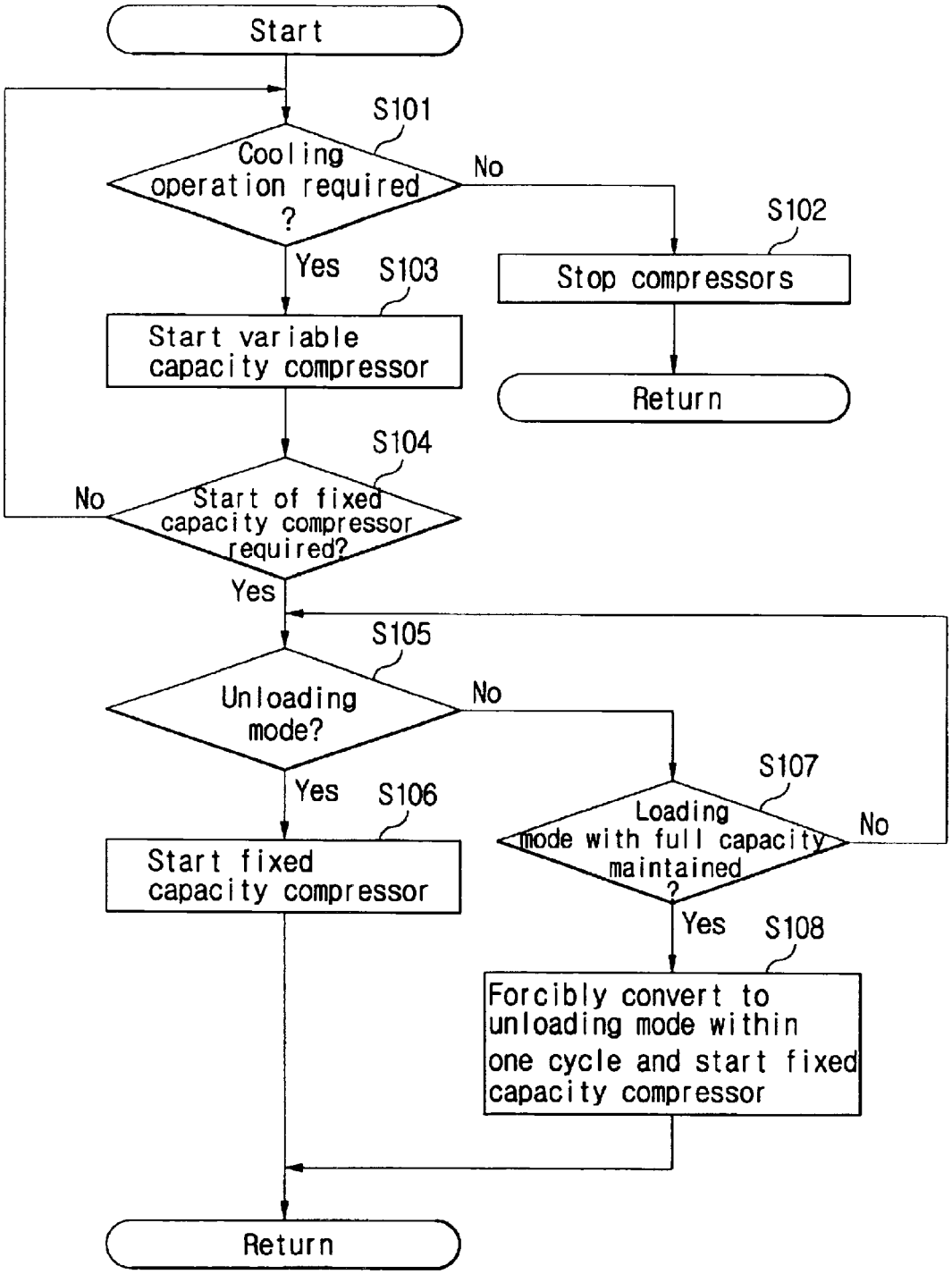
FIG. 6 is a flowchart of the control method of the outdoor control unit included in the air conditioner according to the present invention.

The control operation of the outdoor control unit of the air conditioner according to this invention is described below with reference to FIG. 6.

Upon receiving signals representing the required cooling capacities of the indoor units 9, the outdoor control unit 13 sums up the required cooling capacities, and determines at step S101 whether it is required to operate the indoor units 9 in a cooling mode. When it is not required to operate the indoor units 9 in a cooling mode, the operation of the air conditioner is stopped at step S102.

When it is determined at step S101 that the indoor units 9 are required to be operated in a cooling mode, the outdoor control unit 13 primarily operates the variable capacity compressor 2 at step 103, and controls the variable capacity of said compressor 2 in response to a variation in the sum of the required cooling capacities of the indoor units 9.

During such an operation of the variable capacity compressor 2, the outdoor control unit 13 determines at step S104 whether it is required to start the fixed capacity compressor 4 due to an increase in the sum of the required cooling capacities of the indoor units 9. When it is not required to start the fixed capacity compressor 4, the procedure returns to step S101 so as to operate the air conditioner with the refrigerant compressing capacity of only the variable capacity compressor 2.

When it is determined, at step S104, that it is required to start the fixed capacity compressor 4, the outdoor control unit 13 determines at step S105 whether the variable capacity compressor 2 is in its unloading mode. When it is determined that the variable capacity compressor 2 is in its unloading mode, the outdoor control unit 13 directly starts the fixed capacity compressor 4 at step S106, and returns to the initial stage of the procedure.

When it is determined, at step S105, that the variable capacity compressor 2 is not in its unloading mode, the outdoor control unit 13 determines at step S107 whether the variable capacity compressor 2 maintains its loading mode with full capacity. When it is determined, at step S107, that the variable capacity compressor 2 does not maintain its loading mode with full capacity, the outdoor control unit 13 returns to step S105 and waits for a conversion of the operational mode of the variable capacity compressor 2 from the loading mode into an unloading mode, and starts the fixed capacity compressor 4 when the loading mode of the variable capacity compressor 2 is converted into an unloading mode.

When it is determined, at step S107, that the variable capacity compressor 2 maintains its loading mode with full capacity, the outdoor control unit 13 forcibly converts the operational mode of the variable capacity compressor 2 from the loading mode into an unloading mode for a predetermined period of time, and starts the fixed capacity compressor 4 at step S108 prior to returning to the initial stage of the procedure.

INDUSTRIAL APPLICABILITY

As described above, the present invention provides an air conditioner with a variable capacity compressor and a fixed capacity compressor, and a method of controlling the operation of such an air conditioner. When it is required to start the fixed capacity compressor due to an increase in the sum of the required cooling capacities of the indoor units, the fixed capacity compressor is started during the unloading mode operation of the variable capacity compressor where the pressure difference between the outlet side and inlet side of the variable capacity compressor is minimized. The fixed capacity compressor is thus smoothly started without causing an induction of excessive starting current, and improves the operational reliability of the air conditioner.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An air conditioner, comprising:

a fixed capacity compressor with fixed refrigerant compressing capacity;

a variable capacity compressor operated in a loading mode to discharge refrigerant and in an unloading mode to cease to discharge refrigerant, with a refrigerant compressing capacity of the variable capacity compressor varying in response to a duty control signal determining a loading time and an unloading time within a cycle; and a control unit starting the fixed capacity compressor and the variable capacity compressor with a difference in time so as to prevent a synchronous start of said fixed capacity compressor and the variable capacity compressor, wherein the control unit starts the fixed capacity compressor after starting the variable capacity compressor, and during an unloading mode operation of the variable capacity compressor when the control unit is required to start the fixed capacity compressor.

2. An air conditioner, comprising:

a fixed capacity compressor with fixed refrigerant compressing capacity;

a variable capacity compressor operated in a loading mode to discharge refrigerant and in an unloading mode to cease to discharge refrigerant, with a refrigerant compressing capacity of the variable capacity compressor varying in response to a duty control signal determining a loading time and an unloading time within a cycle; and a control unit starting the fixed capacity compressor and the variable capacity compressor with a difference in time so as to prevent a synchronous start of said fixed capacity compressor and the variable capacity compressor, wherein the control unit starts the fixed capacity compressor after starting the variable capacity compressor, and wherein in the case of the variable capacity compressor constantly maintaining a loading mode even though the control unit is required to start the fixed capacity compressor, said control unit forcibly converts the loading mode of the variable capacity compressor into an unloading mode, and starts the fixed capacity compressor after the mode conversion.

3. A method of controlling an air conditioner including a fixed capacity compressor with fixed refrigerant compressing capacity, and a variable capacity compressor being varied in refrigerant compressing capacity in response to a duty control signal determining a loading time and an unloading time within a cycle, comprising:

starting said variable capacity compressor;

determining whether the fixed capacity compressor is required to start in addition to an operation of the variable capacity compressor; and starting the fixed capacity compressor in accordance with an operational condition of the variable capacity compressor when the fixed capacity compressor is required to start, wherein the starting of the fixed capacity compressor comprises:

determining whether the variable capacity compressor is operating in an unloading mode; and starting the fixed capacity compressor under the condition that the variable capacity compressor is operating in an unloading mode.

4. A method of controlling an air conditioner including a fixed capacity compressor with fixed refrigerant compressing capacity, and a variable capacity compressor being varied in refrigerant compressing capacity in response to a duty control signal determining a loading time and an unloading time within a cycle, comprising:

starting said variable capacity compressor;

determining whether the fixed capacity compressor is required to start in addition to an operation of the variable capacity compressor; and starting the fixed capacity compressor in accordance with an operational condition of the variable capacity compressor when the fixed capacity compressor is required to start, wherein the starting the fixed capacity compressor comprises:

starting the fixed capacity compressor after waiting for a conversion in the operational mode of the variable capacity compressor from a loading mode into an unloading mode when the variable capacity compressor is being operated in the loading mode.

5. A method of controlling an air conditioner including a fixed capacity compressor with fixed refrigerant compressing capacity, and a variable capacity compressor being varied in refrigerant compressing capacity in response to a duty control signal determining a loading time and an unloading time within a cycle, comprising:

starting said variable capacity compressor;

determining whether the fixed capacity compressor is required to start in addition to an operation of the variable capacity compressor; and starting the fixed capacity compressor in accordance with an operational condition of the variable capacity compressor when the fixed capacity compressor is required to start, wherein the starting of the fixed capacity compressor comprises:

starting the fixed capacity compressor after forcibly converting an operational mode of the variable capacity compressor from a loading mode into an unloading mode when the variable capacity compressor is continuously operated in the loading mode.

* * * * *